US007127829B2

(12) United States Patent
Wüster

(10) Patent No.: US 7,127,829 B2
(45) Date of Patent: Oct. 31, 2006

(54) UMBRELLA-TYPE LAUNDRY DRYING APPARATUS

(76) Inventor: Heinrich Wüster, Unterm Hohen Rain 16 A-6460, Imst/Tirol (AU)

( * ) Notice: Subject to any disclaimer, the term of this patent is extended or adjusted under 35 U.S.C. 154(b) by 0 days.

(21) Appl. No.: 11/364,424

(22) Filed: Feb. 28, 2006

(65) Prior Publication Data

US 2006/0180687 A1 Aug. 17, 2006

Related U.S. Application Data

(63) Continuation of application No. PCT/EP2004/009516, filed on Aug. 26, 2004.

(30) Foreign Application Priority Data

Aug. 29, 2003 (AU) ..... A 1366/2003

(51) Int. Cl.
*F26B 25/00* (2006.01)

(52) U.S. Cl. ..... 34/239; 211/197

(58) Field of Classification Search ..... 34/90, 34/239; 211/197

See application file for complete search history.

(56) References Cited

U.S. PATENT DOCUMENTS

| | | | | | |
|---|---|---|---|---|---|
| 176,326 | A * | 4/1876 | Lovejoy | 211/197 |
| 984,556 | A * | 2/1911 | Gerhke | 211/165 |
| 3,920,127 | A * | 11/1975 | LaBeaud | 211/118 |
| 4,732,285 | A * | 3/1988 | Wuster | 211/197 |
| 4,735,322 | A | 4/1988 | Steiner | |
| 5,363,975 | A * | 11/1994 | Meade | 211/197 |
| 5,492,232 | A * | 2/1996 | Ohm | 211/197 |
| 7,000,788 | B1 * | 2/2006 | Wüster | 211/197 |
| 2004/0134870 | A1 * | 7/2004 | Daubach et al. | 211/196 |

FOREIGN PATENT DOCUMENTS

| | | |
|---|---|---|
| AU | 312 548 | 1/1974 |
| CH | 388 894 | 6/1965 |
| DE | 858 3941 | 7/1949 |
| DE | 1 460 816 | 5/1969 |
| DE | 1 816 142 | 5/1969 |
| DE | 1 950 218 | 5/1971 |
| DE | 27 03 758 | 8/1978 |
| GB | 1 325 466 | 8/1973 |

* cited by examiner

*Primary Examiner*—S. Gravini
(74) *Attorney, Agent, or Firm*—Laurence A. Greenberg; Werner H. Stemer; Ralph E. Locher

(57) ABSTRACT

An umbrella-type laundry drying apparatus has a central upright tube which carries a spreading framework for the laundry line. The framework is folded open via a hoisting line. The spreading framework has an upper sleeve which surrounds the upright tube and on which supporting arms arranged in the form of a star are articulated. These arms are articulated at their lower ends to the carrying arms for the laundry line. The carrying arms are articulated with their lower ends on a lower sliding sleeve that surrounds the upright tube, can be fixed in various positions on the upright tube, and is equipped with a force transmission actuable via a tension line. The force transmission has a force step-up and a force transmission element coupled to the tension line. When the tension line is actuated, it generates an upwardly directed movement step of the lower sleeve.

15 Claims, 2 Drawing Sheets

UMBRELLA-TYPE LAUNDRY DRYING APPARATUS

CROSS-REFERENCE TO RELATED APPLICATION

This is a continuing application, under 35 U.S.C. § 120, of copending international application No. PCT/EP2004/009516, filed Aug. 26, 2004, which designated the United States; this application also claims the priority, under 35 U.S.C. § 119, of Austrian patent application No. A 1366/2003, filed Aug. 29, 2003; the prior applications are herewith incorporated by reference in their entirety.

BACKGROUND OF THE INVENTION

Field of the Invention

The invention relates to an umbrella-type laundry drying apparatus, or laundry drier, wherein a central upright tube carries a spreading framework for the laundry line. The framework can be folded open via a hoisting line adjacent to the upright tube. The spreading framework possesses carrying arms for the laundry line, which are arranged in the form of a star and are articulated on a lower sleeve surrounding the upright tube, and supporting arms, which are connected in an articulated manner to the carrying arms and are articulated on an upper sleeve surrounding the upright tube. The hoisting line engages on the lower sleeve which is displaceable along the upright tube and which can be fixed in various positions on the upright tube by means of a releasable locking device.

In prior laundry driers of this type, the upright tube is anchored vertically in the ground at the installation location in a vertical ground sleeve.

When the laundry drier is not in use, the folded-together spreading framework, together with the laundry line, hangs down along the upright tube. The spreading framework is carried by the upper sleeve which is anchored on the upright tube. The spreading framework is drawn downward longitudinally by the lower sleeve being lowered along the upright tube and is folded together with its carrying and supporting arms toward the upright tube. The toggle joints connecting the carrying and supporting arms to one another are extended. The lower sleeve is located just above the ground in the region of the lower end portion of the upright tube. The upper sleeve can be designed to be displaceable along the upright tube and can carry a locking device, by means of which it can be anchored at different heights on the upright tube.

In order to make the laundry drier ready for use, the lower sleeve is raised over a relatively long distance along the upright tube and is anchored to the upright tube. Raising takes place via the hoisting line which at its actuating end is drawn laterally away from the upright tube. By the lower sleeve being raised, the spreading framework is folded open and is shortened in its vertical extent to less than one third. At the same time, the laundry line is spread out and tensioned by the carrying arms moving apart from one another. The tensioning of the laundry line takes place in a last, relatively short part of the upward movement of the lower sleeve.

The ready-to-use laundry drier often remains standing, with the spreading framework folded open, for weeks or months.

Before the laundry drier is taken down, the spreading framework is folded shut. For this purpose, the anchoring of the lower sleeve is released and the spreading framework folds together on itself. In this case, the lower sleeve slides downward along the upright tube, and the carrying and supporting arms of the spreading framework are pivoted toward the upright tube.

The anchoring of the lower sleeve may take place by means of a clamp acting on the upright tube or by means of a spring-loaded pin latching in bores on the upright tube or by way of a spring-loaded detent pawl which latches into a perforated rail or rack fastened to the upright tube (German patent DE 28 55 532 C2, British patent application GB 893 033 A).

In these laundry driers, the laundry line is tensioned by the carrying arms being spread apart from one another, which project laterally from the lower sleeve and, after the spreading framework has been folded open, are inclined only slightly with respect to the horizontal. The carrying arms are spread even further apart from one another by the lower sleeve being pulled up. For this purpose, a relatively high force is required, which has to be applied by the operator via the hoisting line.

Prior art laundry driers of this type have the disadvantage that the force needed for tensioning the laundry line is so great that the laundry line can no longer be tensioned completely, and therefore the wet laundry fastened to it sags and may be soiled.

In order to make it easy for the operator to tension the laundry line, it is known to guide the hoisting line back and forth once or twice between the upper and the lower sleeve of the spreading framework in a similar way to a pulley block. As a result, although the force applied by the operator at the actuating end of the hoisting line is doubled or quadrupled, the speed of movement of the lower sleeve is at the same time halved or reduced to a quarter and the hoisting line is lengthened by a considerable amount which corresponds to double or four times the length of the folded-together spreading framework.

The disadvantage of this is that the hoisting line moving back and forth between the upper and the lower sleeve the spreading framework makes it very laborious and slower to fold open and fold together the spreading framework. To fold the spreading framework open, double or four times the length of the hoisting line has to be drawn out of the spreading framework in relation to the upward movement of the lower sleeve. In this case, the lower sleeve moves upward only at half or a quarter of that speed at which the operator pulls on the actuating end of the hoisting line. Only after the spreading framework has been folded open completely can the force step-up and the respective pulley block be used in order to tension the laundry line. When the spreading framework is being folded together, this double or quadruple length of the hoisting line has to be drawn into the spreading framework again, so that the lower sleeve can move downward into its lower end position along the upright tube. A further disadvantage is the very long length of hoisted line which has to be supplied, with the spreading framework folded open, in order to avoid knots and dirt which would make it difficult to fold the spreading framework together later when this length of the hoisting line is drawn into the spreading framework again.

SUMMARY OF THE INVENTION

It is accordingly an object of the invention to provide a laundry drying apparatus, which overcomes the above-mentioned disadvantages of the heretofore-known devices and methods of this general type and which is yet further improved.

With the foregoing and other objects in view there is provided, in accordance with the invention, an umbrella-type laundry drier, comprising:

a central upright tube;

a spreading framework (i.e., an open-out framework) carried on the upright tube, the spreading framework including:

a lower sliding sleeve surrounding the upright tube and being displaceable along the upright tube;

a releasable locking device configured to lock the lower sleeve in various positions on the upright tube;

carrying arms for carrying laundry line articulated at the lower sleeve in a star shape about the lower sleeve; and supporting arms articulated at the carrying arms and articulated on an upper sleeve surrounding the upright tube;

a hoisting line adjacent the upright tube for folding open the spreading framework, the hoisting line engaging on the lower sleeve which;

a force transmission and a tension line for actuating the force transmission, the force transmission including a force transmission element with a force step-up coupled to the tension line, the force transmission element being configured to generate an upwardly directed movement step of the lower sleeve when the tension line is actuated.

In other words, the objects of the invention are achieved, in a laundry drier of the type mentioned above, in that the lower sliding sleeve is equipped, in addition to the releasable locking device, with a force transmission which is actuable via a tension line and contains a force step-up and which possesses a force transmission element coupled to the tension line and generating an upwardly directed movement step of the lower sleeve when the tension line is actuated.

This configuration makes it possible to pull up the lower sleeve with the aid of the hoisting line in one pull with relatively low force and very quickly, until the lower sleeve is fixed by means of its locking device to the upright tube, with the spreading framework folded open. Subsequently, a pull can be exerted once or more than once on the tension line of the force transmission with relatively low force, in order to raise the lower sleeve further with the aid of the force step-up contained in the force transmission and thereby to tension the laundry line or to increase the tension in the laundry line. When the tension line is released, the force transmission, together with the tension line and force transmission element, returns to the initial position.

In the design according to the invention, the amount of force step-up with which the pulling movement of the tension line is converted in the force transmission into an upward movement of the lower sleeve can be coordianted both with low actuation force and with the size of the respective spreading framework and the number of laundry line items which extend in the latter between the carrying arms and are in each case to be tensioned.

To tension the laundry line in the folded-open spreading framework, the lower sleeve is pulled up by a pull on the tension line of the force transmission, until the locking device of the lower sleeve fixes the latter in a raised position on the upright tube. Subsequently, the tension line of the force transmission is released, and the force transmission, together with the tension line and force transmission element, returns to the initial position.

By the tension line being pulled, first, the force transmission element coupled to the latter is moved toward the upright tube and is supported on the latter. Subsequently, the pull on the tension line, which continues beyond the supporting action, is converted into the upwardly directed movement step of the lower sleeve by the force transmission element by means of the force step-up built into the force transmission. After the release of the tension line, the latter and the force transmission element coupled to it return to the initial position as a result of gravity or as a result of a restoring spring coupled to the tension line and/or to the force transmission element.

The force transmission according to the invention may possess a specific housing wherein the force transmission element coupled to the tension line is accommodated. This housing may be integrated into the lower sleeve. It may also be designed as a prolongation of the lower sleeve which adjoins the lower sleeve upwardly or downwardly.

According to the invention, a force transmission element coupled moveably to the lower sleeve or to the housing of the force transmission and moveable in relation to the lower sleeve as a result of the actuation of the tension line may be provided, which, when the tension line is actuated, is temporarily supported on the upright tube and generates an upwardly directed movement step of the lower sleeve.

The force transmission element may be designed as a two-armed lever which is articulated on the lower sleeve or the housing of the force transmission and of which one lever arm is moved toward the upright tube when the tension line engaging on the other lever arm is pulled. When the tension line is released, the lever is moved back into its initial position by gravity. It may also be coupled to a restoring spring which moves it back into its initial position.

The force transmission element may be designed as a slide displaceable obliquely with respect to the upright tube in the lower sleeve or in the housing of the force transmission and coupled to the tension line. When the tension line is pulled, the slide is moved out downward, moved toward the upright tube and supported on the latter. Subsequently, the slide supported on the upright tube converts the further pull on the tension line into an upwardly directed movement step of the lower sleeve. For the return of the slide into its initial position, a restoring spring coupled to the slide or to the tension line may be provided. The restoring spring may be designed as a tension spring or compression spring.

A slide coupled to a restoring spring and moveable out downward may also be coupled to the hoisting line, by means of which first the spreading framework is folded open and then the laundry line is tensioned. In this case, the restoring spring of the slide is dimensioned such that, when the hoisting line is pulled, the slide is actuated only when the spreading framework is folded open and the tensioned laundry line brakes the further pull-up of the lower sleeve.

In the force transmission, a two-membered force transmission element coupled moveably to the lower sleeve or the housing of the force transmission may be provided, wherein the members arranged one above the other along the upright tube are pivotable with respect to one another when the tension line is actuated, the two-membered force transmission element being temporarily supported with one member on the upright tube when the tension line is actuated, while, with its other member articulated on the lower sleeve or on the housing of the force transmission, it generates an upwardly directed movement step of the lower sleeve.

In this design, a two-membered spring-loaded force transmission element may be provided, wherein the lower member is articulated on the lower sleeve or on the housing of the force transmission and the upper member carries a claw for engagement with notches arranged on the upright tube. When the tension line is actuated, first, the upper member is brought with its claw into engagement with a notch arranged on the upright tube, and then the lower sleeve is pulled up to the notch arranged on the upright tube. In this case, the two members of the force transmission element are pivoted with respect to one another counter to the force of the restoring spring. In the raised position, the lower sleeve is fixed by means of its locking device to the upright tube. After the release of the tension line, the two-membered spring-loaded force transmission element returns to its largely extended initial position again.

A two-membered spring-loaded force transmission element may also be provided, wherein the upper member is articulated on the lower sleeve or on the housing of the force transmission and the lower member is designed as a pawl engageable with notches provided on the upright tube. When the tension line is actuated, first, the lower member is brought into engagement with a notch arranged on the upright tube, and then the lower sleeve is pushed upward away from this notch. In this case, the two members of the force transmission element are pivoted apart from one another counter to the force of a restoring spring. In the raised position, the lower sleeve is fixed by means of its locking device to the upright tube. After the release of the tension line, the two-membered spring-loaded force transmission element returns to its folded-shut initial position again.

In the case of a two-membered force transmission element capable of being folded together, a restoring spring bridging the articulated connection of the two members may be provided, which prestresses the two members into an angled position.

In a two-membered force transmission element capable of being folded together, the two members may be prestressed into an angled position by means of a restoring spring which resiliently supports the member, supportable on the upright tube, in the lower sleeve or in the housing of the force transmission.

In a two-membered force transmission element, one member may be designed as a force step-up lever possessing a lever arm which projects beyond the articulated connection of the two members and on which the tension line engages.

This design is advantageous both in a two-membered force transmission element extended in the state of rest and in a two-membered force transmission element folded together in the state of rest.

The force transmission element may possess a pawl engageable with the notches provided on the upright tube for the releasable locking device of the lower sleeve.

The force transmission element may carry a selflocking roller which is engageable with the upright tube and, in engagement with the latter, blocks a downward movement of the lower sleeve.

In the laundry drier according to the invention, the upright tube may have provided on it a sliding rail cooperating with the releasable locking device of the lower sleeve and with the force transmission element of the force transmission of the lower sleeve. The releasable locking device of the lower sleeve and the force transmission element of the force transmission are provided in each case with a selflocking roller which is engageable with the sliding rail and, in engagement with the latter, blocks a downward movement of the lower sleeve.

In the laundry drier according to the invention, the tension line of the force transmission may be guided via a guide element attached to one of the carrying arms of the spreading framework.

In the laundry drier according to the invention, the hoisting line for folding open the spreading framework may be designed as a tension line for actuating the force transmission, the hoisting line being led, within the spreading framework, away from the lower sleeve upward adjacently to the upright tube, being deflected at the upper sleeve and emerging from the spreading framework via a guide element attached to one of the carrying arms of the spreading framework.

This design of the laundry drier manages with a single line which is pulled several times in order to fold open the spreading framework for spreading out the laundry line and then to tension the laundry line, with the spreading framework folded open. In this case, the lower sleeve is pulled up to the notches arranged one above the other in the upper half of the upright tube and is anchored there via its locking device in one of the notches. After the spreading framework has been folded open, the hoisting line is pulled once or several times more in order to tension the laundry line. In this case, each time, the force transmission is actuated and converts the pull on the hoisting line into an upwardly directed movement step of the lower sleeve. By the hoisting line being pulled, the force transmission element of the force transmission is moved to one of the notches on the upright tube and is supported there on the upright tube. The force transmission element then converts the further pulling movement of the hoisting line into an upward movement of the lower sleeve which is anchored by means of its locking device at a higher notch on the upright tube. The hoisting line is then released again.

In summarizing once more, the umbrella-type laundry drier has a central upright tube which carries, for the laundry line, a spreading framework capable of being folded open via a hoisting line. The spreading framework has an upper sleeve which surrounds the upright tube and on which supporting arms arranged in the form of a star are articulated. These are connected in an articulated manner at their lower ends to the carrying arms for the laundry line which are arranged in the form of a star. The carrying arms are articulated with their lower ends on a lower sleeve which surrounds the upright tube and which is displaceable along the upright tube. The hoisting line engages on the lower sleeve. The lower sleeve can be fixed in various positions on the upright tube by means of a releasable locking device. The lower sleeve is equipped additionally with a force transmission actuable via a tension line and in this case generating an upwardly directed movement step of the lower sleeve. The force transmission contains a force step-up and a force transmission element which is coupled to the tension line and, when the tension line is actuated, generates an upwardly directed movement step of the lower sleeve. The hoisting line may be designed as a tension line for actuating the force transmission.

Other features which are considered as characteristic for the invention are set forth in the appended claims.

Although the invention is illustrated and described herein as embodied in an umbrella-type laundry drying apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
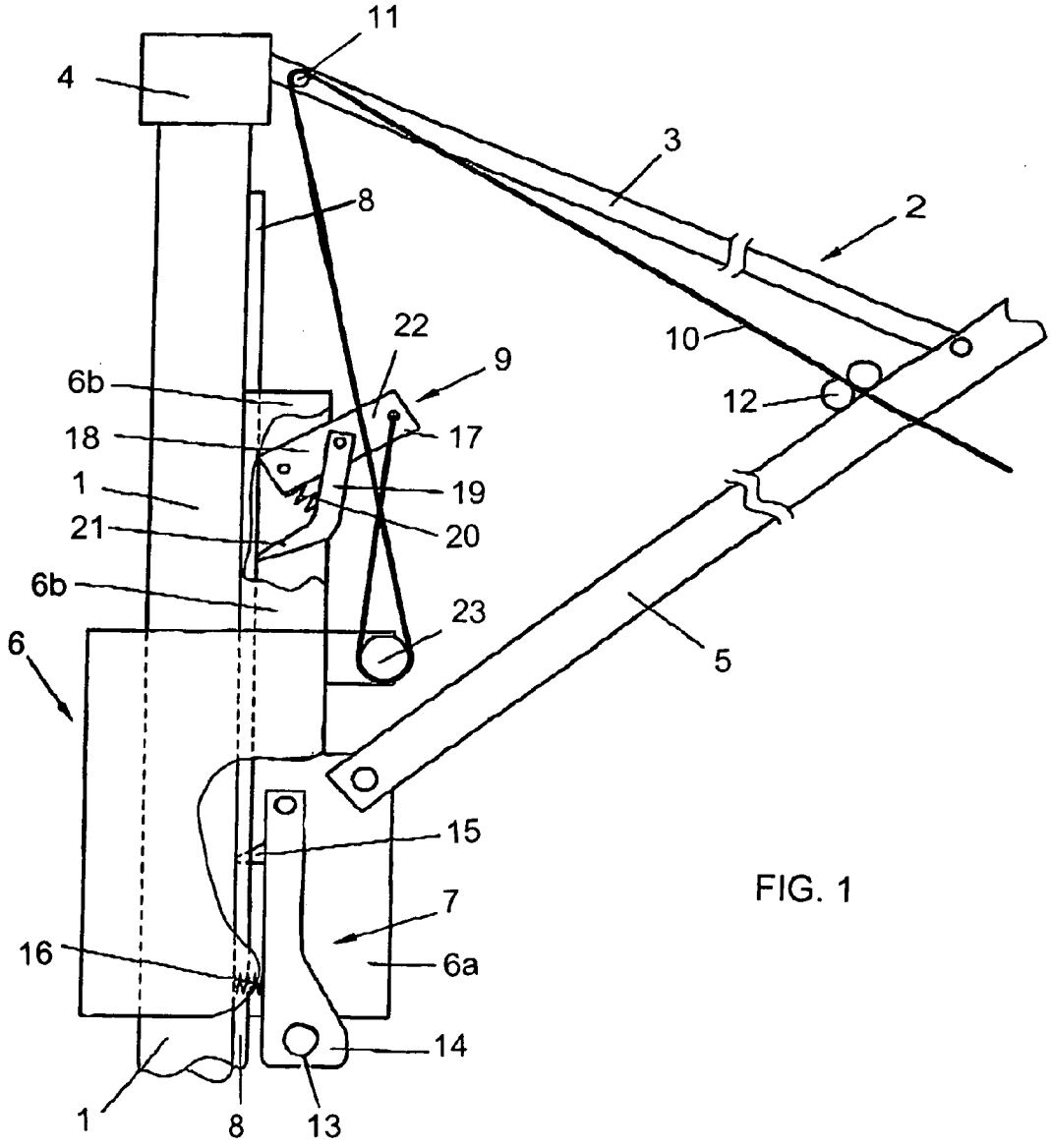
FIG. 1 is a partial diagrammatic side view of an upper part of the umbrella-type laundry drier, with the spreading framework folded open, and the supporting and carrying arms of the spreading framework illustrated shortened. The spreading framework lower sleeve equipped with a locking device and with a force transmission is illustrated partially cut away.

Referring now to the figures of the drawing in detail and first, particularly, to FIG. 1, there is shown a laundry drying apparatus, or laundry drier for short, with a central upright tube 1, on which a spreading framework 2 for the laundry line is seated. This spreading framework possesses, in its upper part, a plurality of supporting arms 3 which are arranged in the form of a star around the upright tube 1 and are articulated with their upper ends on an upper sleeve 4 which surrounds the upright tube 1 and is anchored to the latter. These supporting arms 3 are connected in an articulated manner at their lower ends to the carrying arms 5 of the spreading framework 2 which carry the laundry line. The carrying arms 5 are arranged in the form of a star around the upright tube 1. They are articulated with their lower ends on a lower sleeve 6 which surrounds the upright tube 1 and is displaceable along the latter. The lower sleeve 6 carries a locking device 7, by means of which it can be anchored to the upright tube 1 in a vertical perforated rail 8, and a force transmission 9 by means of which it can be moved upward in steps on the upright tube 1.

The laundry drier possesses a hoisting line 10 which is coupled to the force transmission 9 and which is led away from the lower sleeve 6 upward adjacently to the upright tube 1 and is deflected at a supporting arm 3 away from the upright tube 1, via a deflecting roller 11 adjacent to the upper sleeve 4, to a carrying arm 5, before it leaves the spreading framework 2 via a guide roller 12 attached to this carrying arm 5.

The locking device 7 is accommodated in the lower part 6*a* of the sleeve 6. Said locking device comprises a lever 14 which is mounted pivotably in the lower sleeve 6 and is provided at its lower end with a grip lug 13 which engages with a pawl 15 projecting from it into a hole of the perforated rail 8 and blocks the downward movement of the lower sleeve 6. The lever 14 is prestressed into its locking position by means of a spring 16. It can be pivoted away from the upright tube 1 by hand by means of a pull on its grip lug 13, in order to lift the pawl 15 out of the perforated rail 8. The pawl 15 is provided with an upwardly pointing run-on slope, by means of which it is lifted out of the perforated rail 8 when the lower sleeve 6 is pulled up.

The force transmission 9 is accommodated inside an upper prolongation 6*b* of the sleeve 6. It comprises a two-membered force transmission element 17, of which the upper member 18 is articulated on the lower sleeve 6, while its lower member 19 supportable on the upright tube 1 is loaded by a restoring spring 20 and ends in a pawl 21 engageable with the perforated rail 8 and provided with an upwardly pointing run-on slope. The upper member 18 is designed as a force step-up lever which projects beyond the articulated connection to the lower member 19 and which there forms an outer lever arm 22 on which the hoisting line 10 engages. The latter is led away from the lever arm 22 downward to a lower deflecting roller 23 which is attached to the lower sleeve 6 below the force transmission 9. At the lower deflecting roller 22, the hoisting line 10 is deflected upward and runs upward adjacently to the upright tube 1.

In the position of rest, the lower member 19 is lifted with its pawl 21 out of the perforated rail 8 by means of the restoring spring 20 and is folded next to the upper member 18 which projects obliquely upward away from its articulation on the lower sleeve 6. The force transmission element 17 is folded together on itself.

When the hoisting line 10 is actuated, the latter is pulled out of the spreading framework 2 away from the upright tube 1 via the guide roller 12 and pulled downward in the lower sleeve 6 toward the lower deflecting roller 23. The force transmission element 17 folded together on itself is pulled downward on the outer lever arm 22 of its upper member 18, pivoted toward the upright tube 1, supported on the latter and finally extended longitudinally. As a result of the extension movement of the force transmission element 17, the lower sleeve 9 is moved upward on the upright tube 1. When the hoisting line 10 is released, the force transmission element 17 is folded together again by means of the restoring spring 20.

To fold open the spreading framework 2, the hoisting line 10 is actuated and the lower sleeve 6 is pulled up on the upright tube 1 until it is detained by its locking device 7 on the upright tube 1, with the spreading framework 2 folded open. In the force transmission 9, the two-membered force transmission element 17 is extended. The force transmission element 17 remains extended until the hoisting line 10 is released.

After the spreading framework 2 has been folded open, the hoisting line 10 is actuated once or several times more in order to raise the lower sleeve 6 a further amount with the aid of the force transmission 9 and to tension the laundry line by means of the carrying arms 5 of the spreading framework 2 which in this case move apart from one another. When the hoisting line 10 is actuated, the lower sleeve 6 is raised as a result of the extension movement of the two-membered force transmission element 17 of the force transmission 9, until the pawl 15 of the locking device 7 latches in a higher hole of the perforated rail 8. Subsequently, the hoisting line 10 is released, and the two-membered force transmission element 17 returns into its folded-together state. When the hoisting line 10 is actuated again, the force transmission element 17 is brought into engagement with the upright tube 1 again and the lower sleeve 6 is raised as a result of the extension movement of the force transmission element 17, until the pawl 15 of the locking device 7 latches in a higher hole of the perforated rail 8.

Figure 2:
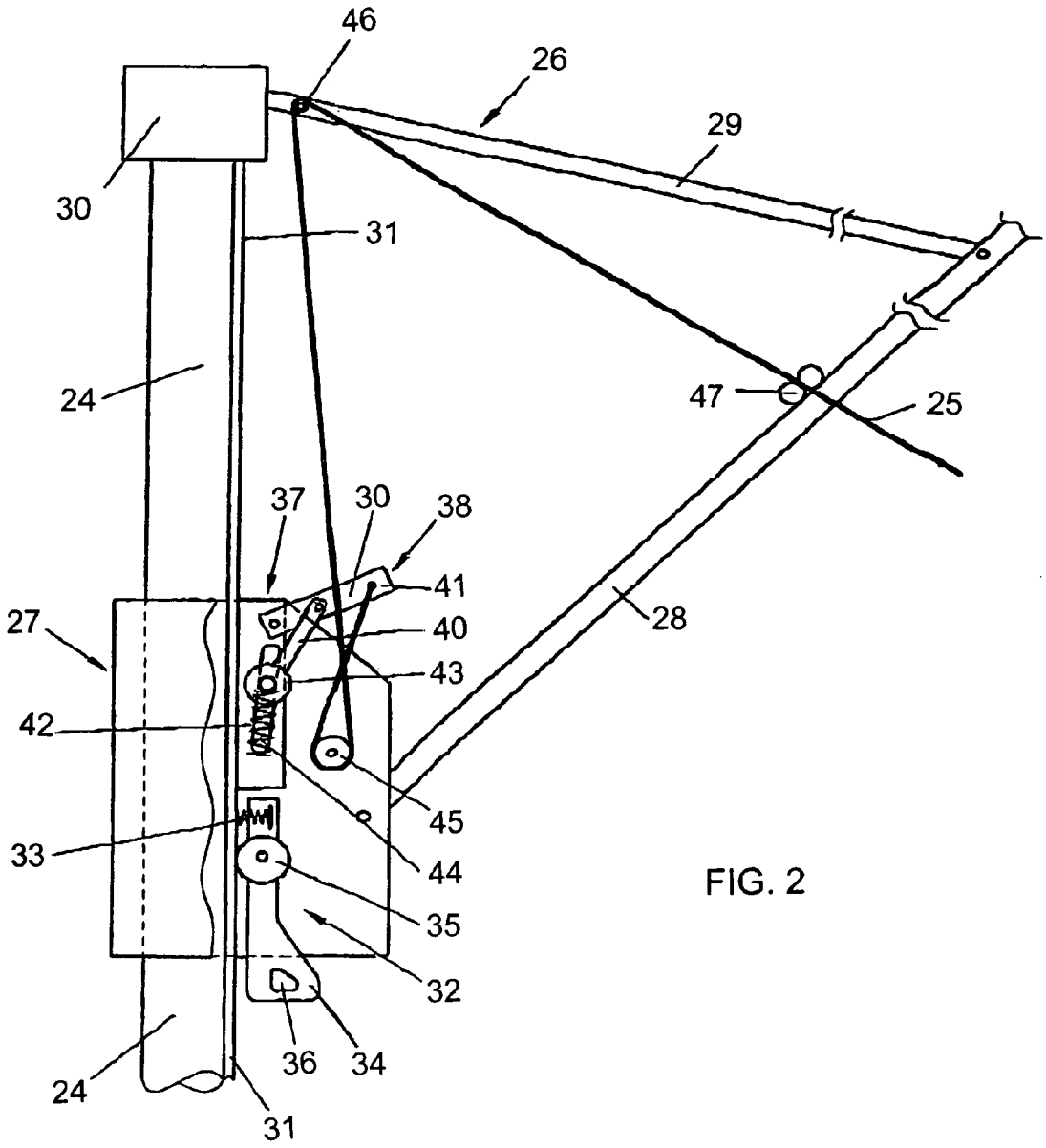
FIG. 2 is a similar, partial diagrammatic side view of an upper part of the umbrella-type laundry drier according to the invention. The spreading framework is folded open, the supporting and carrying arms of the spreading framework are illustrated, shortened, and the spreading framework lower sleeve equipped with a locking device and with a force transmission is partially cut away.

FIG. 2 shows a further laundry drier with a central upright tube 24 on which a spreading framework 26 actuable by means of a hoisting line 25 is seated. The laundry line is carried by the carrying arms 28 which are articulated on the lower sleeve 27 of the spreading framework 26 and are connected in an articulated manner to the upper supporting arms 29 of the spreading framework 26. The supporting arms 29 are articulated on the upper sleeve 30 of the spreading framework 26, said upper sleeve being anchored, in turn, on the upper end of the upright tube 24.

The lower sleeve 27 of the spreading framework 26 is displaceable along the upright tube 24 provided with a sliding rail 31. Said lower sleeve carries in its lower half a locking device 32, by means of which it can be fixed to the upright tube 24. The locking device 32 possesses a lever 34 which is mounted pivotably in the lower sleeve 27 and is loaded by a spring 33 and which presses a selflocking roller 35 against the sliding rail 31 and thus blocks the downward movement of the lower sleeve 27. The selflocking roller 35 can be rotated in only one direction and automatically blocks rotation in the opposite direction. In engagement with the sliding rail 31, the roller 35 can be rotated only during the upward movement of the lower sleeve 27. A grip lug 36 is formed at the lower end of the lever 34. By a pull on the grip lug 36, the lever 34 can be pivoted away from the upright tube 24, in order to lift off the roller 35 from the sliding rail 31 and allow a downward movement of the lower sleeve 27. When the lever 34 is released, the selflocking roller 35 is pressed against the sliding rail 31 again and blocks the downward movement of the lower sleeve 27.

The lower sleeve 27 of the spreading framework 26 carries in its upper half a force transmission 37, by means of which said lower sleeve can be moved upward in steps along the upright tube 24. The force transmission 37 provides a two-membered force transmission element 38 extendable longitudinally along the upright tube 24 by a pull on the hoisting line 25. Said force transmission element is articulated with its upper member 39 on the lower sleeve 27 near the upper sleeve edge. The upper member 39 possesses an arm 41 which projects beyond the articulated connection of said upper member to the lower member 40 and on which the hoisting line 25 engages. The lower member 40 carries at its lower end a selflocking roller 43 which is adjacent to the sliding rail 31 and is displaceable downward in an oblique sliding guide 42 of the lower sleeve 27 and which is pressed upward in the lower sleeve 27 by a restoring spring 44 running parallel to the sliding guide 42.

The hoisting line 25 is led in the lower sleeve 27 downward away from the outer arm 41 of the upper member 39 of the force transmission element 38 and is deflected upward at a lower deflecting roller 45 arranged below the force transmission 37. The hoisting line 25 runs away from the lower sleeve 27 upward, next to the upright tube 1, to an upper deflecting roller 46 which is attached to a supporting arm 29 adjacently to the upper sleeve 30 of the spreading framework 26. At the upper deflecting roller 46, the hoisting line 25 is deflected outward, away from the upright tube 24, to the carrying arm 28 connected in an articulated manner to the supporting arm 29, before it leaves the spreading framework 26 via a guide roller 47 attached to this carrying arm 28.

In the position of rest of the force transmission 37, the selflocking roller 43 is lifted off from the sliding rail 31 somewhat by the restoring spring 44. The upper member 39 of the force transmission element 38 stands obliquely upward away from its articulation on the lower sleeve 27. The lower member 40 is folded in toward the upper member 39. The force transmission element 38 is folded together on itself.

When the hoisting line 25 is actuated, the latter is pulled out of the spreading framework 26 away from the upright tube 24 via the guide roller 47. In the lower sleeve 27, the force transmission element 38 folded together on itself is pulled downward by the hoisting line 25 on the outer arm 22 of the upper member 18 and is extended longitudinally. The lower member 40 pushes the selflocking roller 43 downward in the sliding guide 42 counter to the force of the restoring spring 44, until the selflocking roller 43 bears against the sliding rail 31 and blocks the further downward movement of the lower member 40. The force transmission element 38 is then supported on the upright tube 24 via the blocking roller 43, so that the lower sleeve 27 is moved upward on the upright tube 24 as a result of the further extension movement of the force transmission element 38. When the hoisting line 25 is released, the selflocking roller 43 is pushed upward in the sliding guide 42 by the restoring spring 44 and is lifted off somewhat from the sliding rail 31. At the same time, the force transmission element 38 is folded together on itself.

To fold open the spreading framework 26, the hoisting line 25 is actuated and the lower sleeve 27 is pulled up on the upright tube 24 until the spreading framework 26 is folded open. While the lower sleeve 27 is being pulled up, the selflocking roller 35 of the locking device 32 bears against the sliding rail 31 and blocks the downward movement of the lower sleeve 27. When the hoisting line 25 is actuated, the two-membered force transmission element 38 of the force transmission 37 is also extended. The force transmission element 38 remains extended until the hoisting line 25 is released.

After the spreading framework 62 has been folded open, the hoisting line 25 is actuated once or several times more, in order to raise the lower sleeve 27 a little more with the aid of the force transmission 37 and tension the laundry line by means of the supporting arms 28 of the spreading framework 26 which in this case move apart from one another. When the hoisting line 25 is actuated, the two-membered force transmission element 38 is extended and is pushed downward with its lower member 40 along the sliding rail 31, until the selflocking roller 43 bears against the sliding rail 31 and blocks the further downward movement. Subsequently, the lower sleeve 27 is moved upward on the upright tube 24 as a result of the further extension movement of the force transmission element 38. While the lower sleeve 27 is being pulled up, the selflocking roller 35 of the locking device 32 bears against the sliding rail 31 and blocks the downward movement of the lower sleeve 27. In the position of the lower sleeve 27 wherein the latter is raised via the force transmission element 38, the hoisting line 25 is released. The restoring spring 44 pushes the selflocking roller 43 of the force transmission element 38 upward in the sliding guide 42 and lifts off the roller 43 somewhat from the sliding rail 31. At the same time, the force transmission element 38 is pushed upward by the restoring spring 44 and is folded together on itself. When the hoisting line 25 is actuated again, the force transmission element 38 is brought into engagement with the upright tube 24 again, and the lower sleeve 27 is raised again as a result of the extension movement of the force transmission element 38.

I claim:

1. An umbrella-type laundry drier, comprising:

a central upright tube;

a spreading framework carried on said upright tube, said spreading framework including:

a lower sleeve surrounding said upright tube and being displaceable along said upright tube;

a releasable locking device configured to lock said lower sleeve in various positions on said upright tube;

carrying arms for carrying laundry line articulated at said lower sleeve in a star shape about said lower sleeve; and supporting arms articulated at said carrying arms and articulated on an upper sleeve surrounding said upright tube;

a hoisting line adjacent said upright tube for folding open said spreading framework, said hoisting line engaging on said lower sleeve which;

a force transmission and a tension line for actuating said force transmission, said force transmission including a force transmission element with a force step-up coupled to said tension line, said force transmission element being configured to generate an upwardly directed movement step of said lower sleeve when said tension line is actuated.

2. The laundry drying apparatus according to claim 1, wherein said force transmission includes a housing connected to said lower sleeve and accommodating therein said force transmission element coupled to said tension line.

3. The laundry drying apparatus according to claim 2, which comprises a force transmission element coupled moveably to said lower sleeve or to said housing of said force transmission and moveably in relation to said lower sleeve as a result of the actuation of said tension line, and wherein said force transmission element, when said tension line is actuated, is supported temporarily on said upright tube and generates an upwardly directed movement step of said lower sleeve.

4. The laundry drying apparatus according to claim 3, wherein said force transmission element is loaded by a restoring spring.

5. The laundry drying apparatus according to claim 2, which comprises a two-membered force transmission element with two members moveably coupled to said lower sleeve or said housing of said force transmission, said two members being disposed one above the other along said upright tube and pivotable with respect to one another when said tension line is actuated, and wherein, when said tension line is actuated, said two-membered force transmission element is temporarily supported with one member on said upright tube, while, with the respectively other member articulated on said lower sleeve or on said housing of said force transmission, said force transmission element generates the upwardly directed movement step of said lower sleeve.

6. The laundry drying apparatus according to claim 5, which comprises a restoring spring bridging an articulated connection of said two members of said force transmission element, said restoring spring biasing said two members into an angled position.

7. The laundry drying apparatus according to claim 5, which comprises a restoring spring biassing said two members of said force transmission element into an angled position and said restoring spring resiliently supporting a member, supportable on said upright tube, in said lower sleeve or said housing of said force transmission.

8. The laundry drying apparatus according to claim 5, wherein one of said members of said force transmission element is a force step-up lever including a lever arm projecting beyond an articulated connection of said two members at which said tension line engages.

9. The laundry drying apparatus according to claim 1, wherein said force transmission element is a pawl engageable with notches formed in said upright tube for said releasable locking device of said lower sleeve.

10. The laundry drying apparatus according to claim 1, wherein said force transmission element carries a selflocking roller engageable with said upright tube and configured to block a downward movement of said lower sleeve when said roller is in contact with said upright tube.

11. The laundry drying apparatus according to claim 2, wherein said housing of said force transmission is integrated into said lower sleeve.

12. The laundry drying apparatus according to claim 2, wherein said housing of said force transmission is a prolongation of said lower sleeve and adjoins said lower sleeve upwardly or downwardly.

13. The laundry drying apparatus according to claim 1, which comprises a sliding rail on said upright tube, said sliding rail cooperating with said releasable locking device of said lower sleeve and with said force transmission element of said force transmission of said lower sleeve, and wherein said releasable locking device of the lower sleeve and said force transmission element of said force transmission each includes a selflocking roller engageable with said sliding rail and, in engagement with said sliding rail, blocking a downward movement of said lower sleeve.

14. The laundry drying apparatus according to claim 1, wherein said tension line of said force transmission is guided via a guide element attached to one of said carrying arms of said spreading framework.

15. The laundry drying apparatus according to claim 1, wherein said hoisting line for folding open said spreading framework is a tension line for actuating said force transmission, and said hoisting line is guided, within said spreading framework, away from said lower sleeve upward adjacent to said upright tube, deflected at said upper sleeve and emerging from said spreading framework via a guide element attached to one of said carrying arms of said spreading framework.

* * * * *

UNITED STATES PATENT AND TRADEMARK OFFICE

CERTIFICATE OF CORRECTION

PATENT NO. : 7,127,829 B2
APPLICATION NO. : 11/364424
DATED : October 31, 2006
INVENTOR(S) : Heinrich Wüster It is certified that error appears in the above-identified patent and that said Letters Patent is hereby corrected as shown below:

On the TITLE PAGE,

Item (76),

The inventor's residence should read: -- Imst/Tirol (AT) --

TITLE PAGE, Item 30,

Foreign Application Priority Data should read: -- Aug. 29, 2003 (AT) --

TITLE PAGE, ITEM (56) Foreign Patent Documents should read: -- DE 858 391 7/1949 --

-- DE 1 816 142 7/1970 --

Signed and Sealed this

Twenty-third Day of January, 2007

JON W. DUDAS
*Director of the United States Patent and Trademark Office*